US006021651A

United States Patent [19]

Shima

[11] Patent Number: 6,021,651

[45] Date of Patent: Feb. 8, 2000

[54] FLAT KNITTING MACHINE HAVING A YARN FEEDING SYSTEM

[75] Inventor: Masahiro Shima, Wakayama, Japan

[73] Assignee: Shima Seiki Manufacturing, Ltd., Wakayama, Japan

[21] Appl. No.: 09/136,955

[22] Filed: Aug. 20, 1998

[30] Foreign Application Priority Data

Aug. 21, 1997 [JP] Japan ..... 9-225427

[51] Int. Cl.[7] ..... D04B 15/52

[52] U.S. Cl. ..... 66/126 A; 66/126 R; 66/64

[58] Field of Search ..... 66/126 R, 127, 66/128, 129, 126 A, 125 R, 133, 64, 214

[56] References Cited

U.S. PATENT DOCUMENTS 5,031,426 7/1991 Ikenaga ..... 66/126 R
5,345,789 9/1994 Yabuta ..... 66/126 A
5,544,502 8/1996 Nakamori et al. ..... 66/126 A

FOREIGN PATENT DOCUMENTS 2459693 6/1975 Germany ..... 66/126 R
2137234 10/1984 Japan .
5025758 2/1993 Japan .
2137234 10/1984 United Kingdom ..... 66/126 R

*Primary Examiner*—Larry Worrell
*Attorney, Agent, or Firm*—Nikaido Marmelstein Murray & Oram LLP

[57] ABSTRACT

Plural carrier rails are arranged radially relative to a trick gap, and yarn carriers are made to run on the rails. In the yarn carrier, a feeder rod is mounted on a yarn rod guide so that the the rod can slide up and down. The feeder rod is pushed up by a spring coil, and the feeder rod is pushed down by a catching member toward the trick gap.

9 Claims, 12 Drawing Sheets

FLAT KNITTING MACHINE HAVING A YARN FEEDING SYSTEM

FIELD OF THE INVENTION

The present invention relates to a yarn feeding system for a flat knitting machine that feeds yarn to needles provided on needle beds.

PRIOR ART

When multiple color yarns or yarns of various kinds are used in knitting, a carrier rail is provided above needle beds along the longitudinal direction thereof, and multiple yarn carriers are supported on this rail. And a carriage is made to reciprocate over the needle beds to actuate needles.

At the time of knitting, when a needle arranged on a needle bed is made to protrude into a yarn feeding position, a yarn feeder having a yarn feeding eyelet provided at the lower end of a yarn carrier must feed yarn at a point close to the top end of the needle. However, if yarn feeders of all of multiple yarn carriers arranged on a carrier rail are positioned close to the top end of a needle, when a yarn carrier that is moving crosses a yarn carrier that is standing, their yarn feeders will collide with each other or their yarn feeders will collide with a needle or a sinker. To solve such problems, the present applicant proposed a yarn feeding system that is described in Japanese Provisional Patent Hei 5-25658.

In this Japanese Provisional Patent Hei 5-25658, a catching means for selecting a yarn carrier and catching the yarn carrier, and a lowering means for bringing a yarn feeder provided at the top end of a feeder rod of a yarn carrier are provided between a carriage and a yarn carrier. When a catching pin of the catching member is to trail a yarn carrier, the lowering means will lower the top end of the feeder rod, that is energized to rise by a spring, against the spring's energization for rising. Thus a yarn feeding system that avoids the above problems in this way has been disclosed.

In the above yarn feeding system, however, the entire feeder rod is raised or lowered. Hence a spring coil, etc. of the lowering means, that energizes the feeder rod to rise and is interlocked with catching of the yarn feeder to lower the feeder rod, is required to exert a large force. This, in turn, gives large loads to supporting parts, etc. that support the feeder rod so that it can be moved up and down. The resulting yarn feeding system is inevitably larger in size, more complex in mechanism and heavier in weight.

SUMMARY OF THE INVENTION

In view of the above problems, one object of the present invention is to provide a flat knitting machine having a yarn feeding system that is simple in construction, small in size and light in weight, and can bring the yarn feeder of a yarn carrier close to the top end of a needle when the needle that is arranged on a needle bed is made to protrude to a yarn feeding position.

Another object of the present invention is to provide a yarn feeding system that can moderate interference of yarn carriers.

A flat knitting machine having a yarn feeding system according to the present invention is a flat knitting machine having at least a pair of needle beds with a large number of needles, one in a front and one in a back, top ends of said needle beds being opposed to each other so as to form a trick gap in between, said flat knitting machine having a yarn feeding system comprising at least a carrier rail arranged above the needle beds and a yarn carrier movable along the carrier rail and for feeding yarn to the needles, said flat knitting machine characterized in that
- said yarn carrier comprises
  - a base movable along the carrier rail;
  - a plate guide having one end fixed to said base and extending from said base towards the trick gap; and
  - a feeder rod supported by said plate guide, extending from the base towards the trick gap, movable vertically, and having a yarn feeding eyelet at a bottom end towards the trick gap side, and that
  - said flat knitting machine further comprises
    - raising means for keeping said feeder rod in a raised position while the yarn feeder is in a stand-by position; and
    - lowering means for lowering said feeder rod while yarn is to be fed from said yarn feeding eyelet to a needle.

With this arrangement, by lowering the feeder rod, the yarn feeding eyelet at the bottom end thereof is brought close to the top end of the needle, and in turn, yarn is reliably fed to the needle. Moreover, as only the feeder rod being light in weight is moved vertically, it is easy to move the feeder rod vertically, and the yarn feeding system is reduced in size.

Preferably, said flat knitting machine having a yarn feeding system is characterized by
- a plurality of said carrier rails and a plurality of said yarn carriers being provided;
- said plate guide and said base being an integral member;
- the plate guides of the plural yarn carriers being arranged in radial directions having a center at the trick gap; and
- the feeder rods being movable up and down in the radial directions.

By providing the guide and the base as an integral member, the yarn carrier is made simpler in structure and lighter in weight. Moreover, a clearance between two adjacent yarn guides is made larger, and a clearance between the feeder rod and other guides or feeder rods can be made larger when the feeder rod is raised.

Preferably, said flat knitting machine having a yarn feeding system is characterized by said plate guide being broader than said feeder rod and having two side edges along the carrier rail being tapered towards the bottom end thereof.

With this arrangement, when a yarn carrier crosses with another yarn carrier, if their guides contact with each other, the contacting point will shift from an upper part to a lower part of side edges, and the yarn carriers will be flexed and will cross more closely. Thus impacts of the collision between these yarn carriers is moderated.

Preferably, said flat knitting machine having a yarn feeding system further comprises a member being located near the bottom end of said feeder rod and above the yarn feeding eyelet, surrounding the feeder rod, being thicker in an upper part thereof than in a lower end thereof, being tapered towards the yarn feeding eyelet, and having an ellipsiodal horizontal section having a major axis being parallel with the carrier rail and a minor axis being perpendicular to the carrier rail.

With this arrangement, when the yarn carrier cross another yam carrier, on the side of their feeder rods, the members of which sections are elliptic will contact with each other. As they are free of angles, impacts of collision are moderate, and they push away from each other to separate the yarn carriers.

Preferably, said flat knitting machine having a yarn feeding system is characterized by a yarn feeding member mounted on a lower end of said feeder rod, tapered towards the trick gap, and having a bottom end forming said yarn feeding eyelet.

The yarn feeding member is tapered, and can be made thinner than the feeder rod. Hence the yarn feeding member at the bottom end of the feeder rod will not interfere with a yarn from another yarn carrier when the yarn carrier is moved.

Preferably, said plurality of carrier rails are arranged along an arc facing said trick gap.

With this arrangement, all the yarn carriers arranged over needle beds is made of the same shape. Moreover, the higher is the position, the greater is the clearance between the yarn carriers. Hence collision is prevented by raising feeder rods.

Further, preferably, said raising means comprises a spring having two ends, one end mounted on said base and one end mounted on the feeder rod, and pushing up the feeder rod; and a second guide is mounted on said base and guides the feeder rod vertically.

With this arrangement, the feeder rod is pressed upward by the spring coil, and the vertical movement of the feeder rod is guided by the guide member.

Preferably, said flat knitting machine having a yarn feeding system furthere comprises:

a catching member for catching and trailing the yarn carrier and comprising a main part, a pin driven by a solenoid so as to descend from the main part, swing members swingably mounted on the main part, and a rotational arm having two ends and rotatably mounted at said two ends, one at said swing member and one at said pin; and an engaging member formed on an upper end of the base of said yarn carrier and engageable with the pin of said catching member, wherein said feeder rod has a top engageable with and pushed down by said swing member while the swing member is swung towards the top.

With this arrangement, before the catching member catches the yarn carrier, a swing member will be swung to a position at which the swing member will push down the top of the feeder rod, and while the catching member travels, the swing member pushes down the top of the feeder rod. When the catching member does not catch, the swing member swings to a position at which the member will not push down the top of the feeder rod. Hence the push-down distance of the feeder rod by the swing member is made longer than the downward stroke of the pin for catching.

Preferably, said flat knitting machine having a yarn feeding system is characterized by a pair of swing pieces provided on the upper end of said base, being able to swing in a vertical plane, and having a gap in between and respective ends at said gap pushed up, and by said engaging member comprising said gap.

With this arrangement, with the travel of the catching member, initially the catching pin pushes down one swing member and runs onto it, and when the pin reaches the gap between the pair of swing members, the swing members will be pushed up by a spring coil and the catching pin will be locked by the pair of swing members. As a result, the yarn carrier is caught and trailed reliably.

EMBODIMENTS

Figure 1:
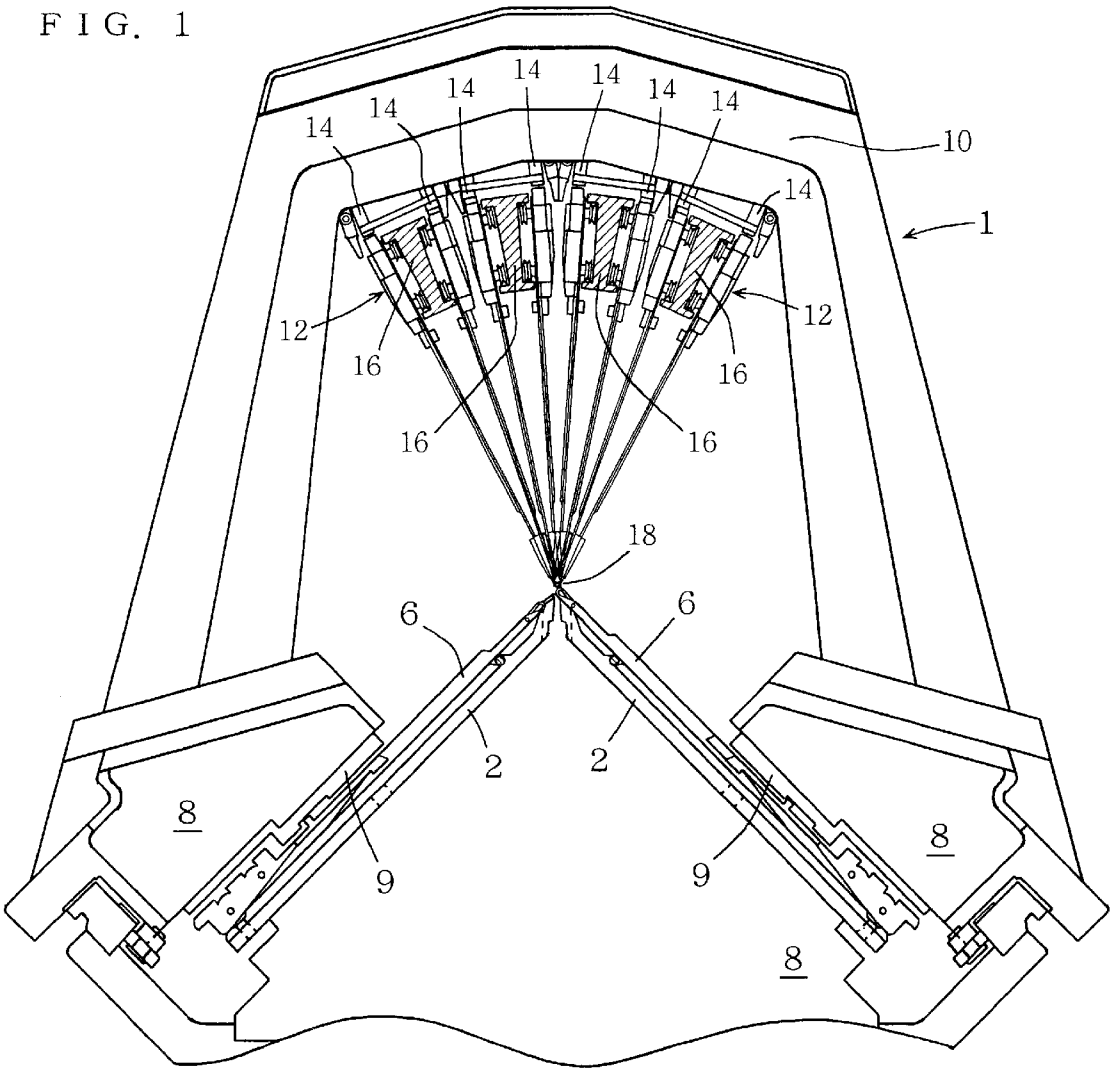
FIG. 1 is a side view of a flat knitting machine provided with a yarn feeding system of an embodiment.

Some embodiments will be described with reference to the attached drawings. FIG. 1 is a side view of a flat knitting machine having a yarn feeding system according to the present invention, and 1 denotes the flat knitting machine generally.

In this flat knitting machine 1, top ends of a pair of needle beds 2, one in the front and one in the rear, are opposed to each other on a frame 4, with the needle beds 2 forming an inverted V when seen from the side. Plural needles 6 are mounted on each needle bed 2 so that these needles 6 can be moved forward and backward. Carriages 8 are driven, by a belt driving means not illustrated, over the tops of the needle beds 2 to reciprocate and move needles 6 forward or backward through knitting cams 9 mounted on the carriages 8. The carriages 8 are integrally provided with a gate arm 10 that strides over the front and back needle beds 2. A catching member 14 for catching a yarn carrier 12 is mounted on the gate arm 10.

Four carrier rails 16 are supported by supporting brackets, that are provided on both ends of the flat knitting machine and are not illustrated, above the needle beds 2 in the longitudinal direction thereof. The carrier rails 16 are arranged radially with the center being close to the top ends of the needles 6 arranged on the needle beds 2. Yarn carriers 2, that will be described later, are movably supported on both the front and back faces of each carrier rail 16. The section of the carrier rail 16 is tapered downwards, and a yarn feeder 18 that is provided at the bottom end of each yarn carrier is positioned close to the top ends of needles 6 arranged on needle beds 2. When the carrier rails 16 are radially arranged as described above, all the yarn carriers supported by respective carrier rails 16 can have an identical form. In the present embodiment, two needle beds 2 are used. The number of needle beds 2, however, is not limited to two. For example, three or more needle beds 2 may be used.

Figure 2:
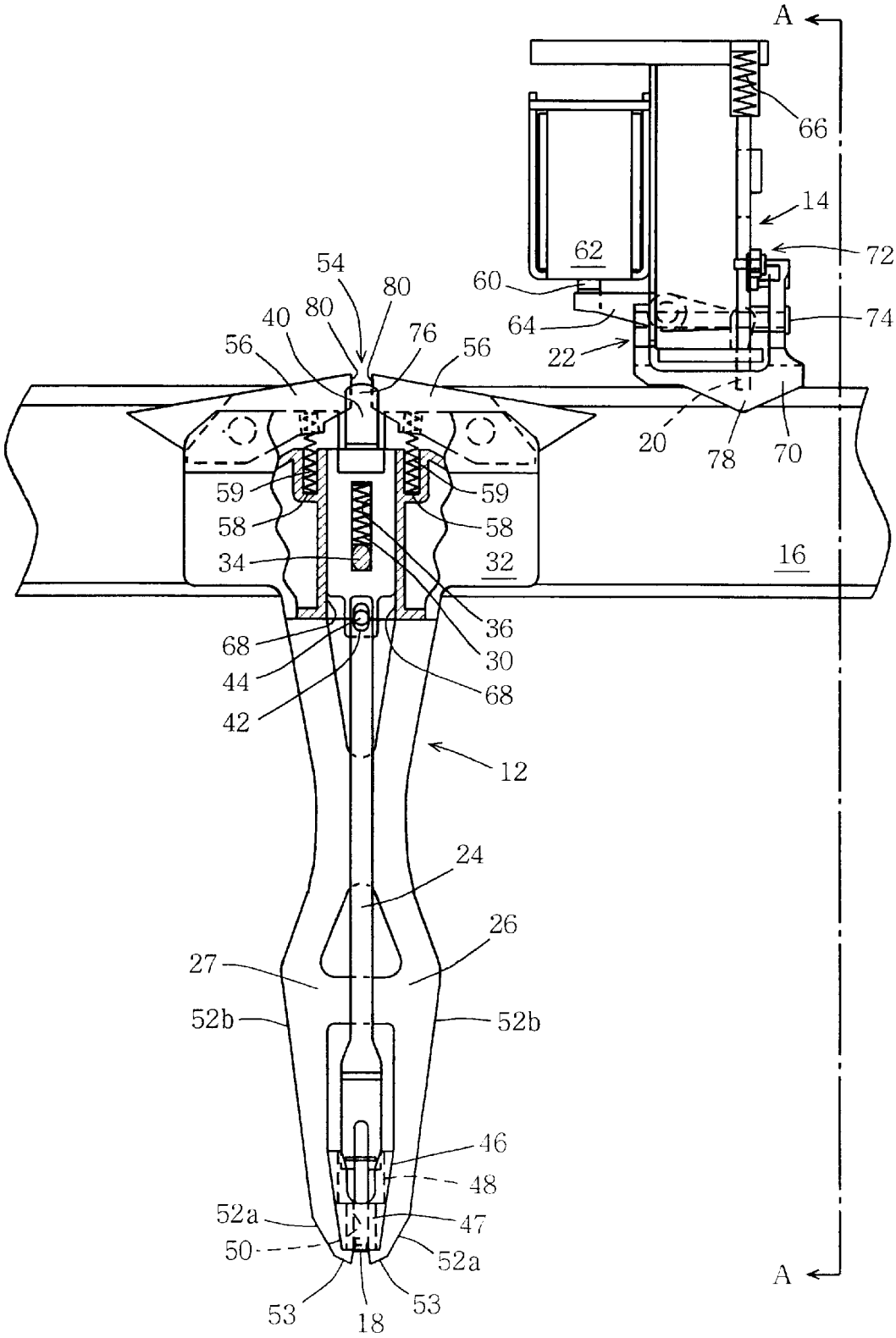
FIG. 2 is a partially cutaway front view of the yarn feeding system of FIG. 1.
Figure 3:
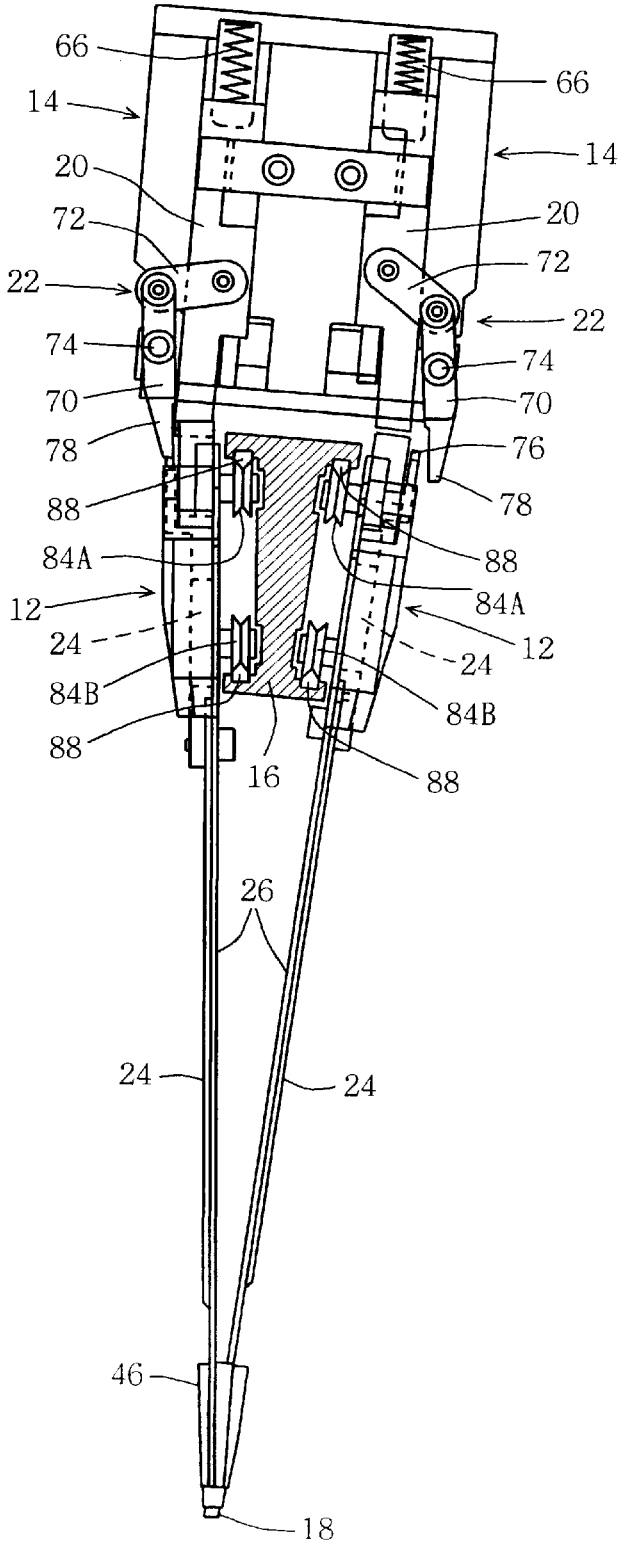
FIG. 3 is a side view of the yarn feeding system along the line A—A of FIG. 2.

FIG. 2 is a partially cutaway front view of the yarn feeding system, and FIG. 3 is a side view of the yarn feeding system along the line A-A. The yarn feeding system comprises a yarn carrier 12, a catching member 14 and a lowering means 22. The yarn carrier 12 is movably supported on a carrier rail 16 and feeds yarn to a needle 6. The catching member 14 catches and carries the yarn carrier 12 by means of a catching pin 20 that can be operated by a carriage 8 to move forward and backward. The lowering means 22 lowers a yarn feeder 18 that is provided at the lower end of the yarn carrier 12 close to the top end of a needle 6.

Figure 4:
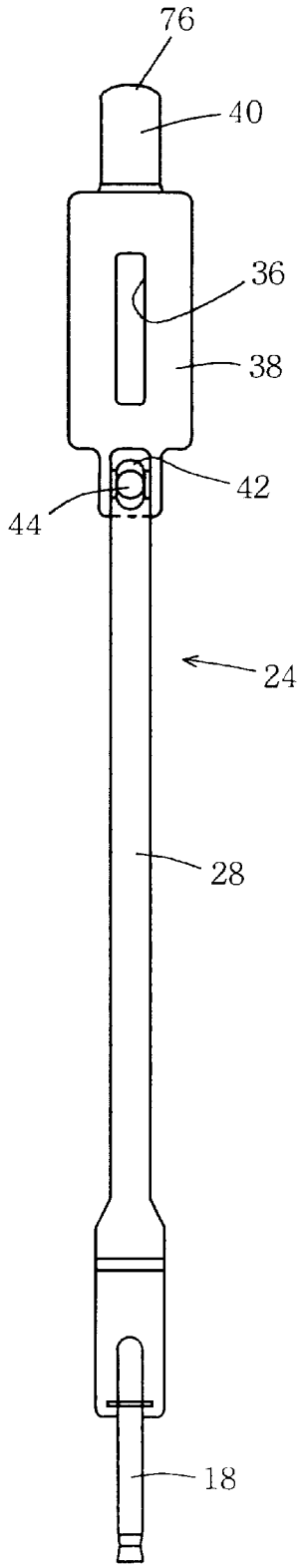
FIG. 4 is a front view of a feeder rod of a yarn carrier.
Figure 5:
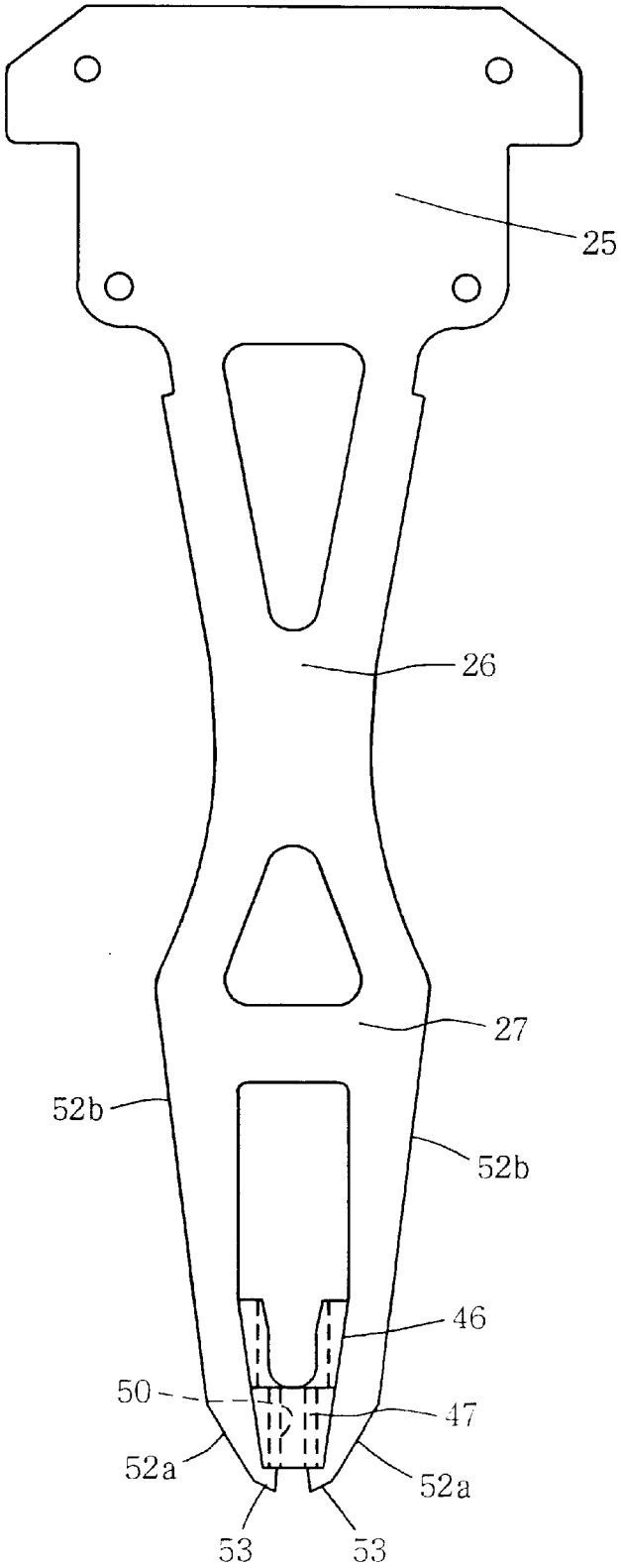
FIG. 5 is a front view of a feeder rod guide of the yarn carrier.
Figure 6:
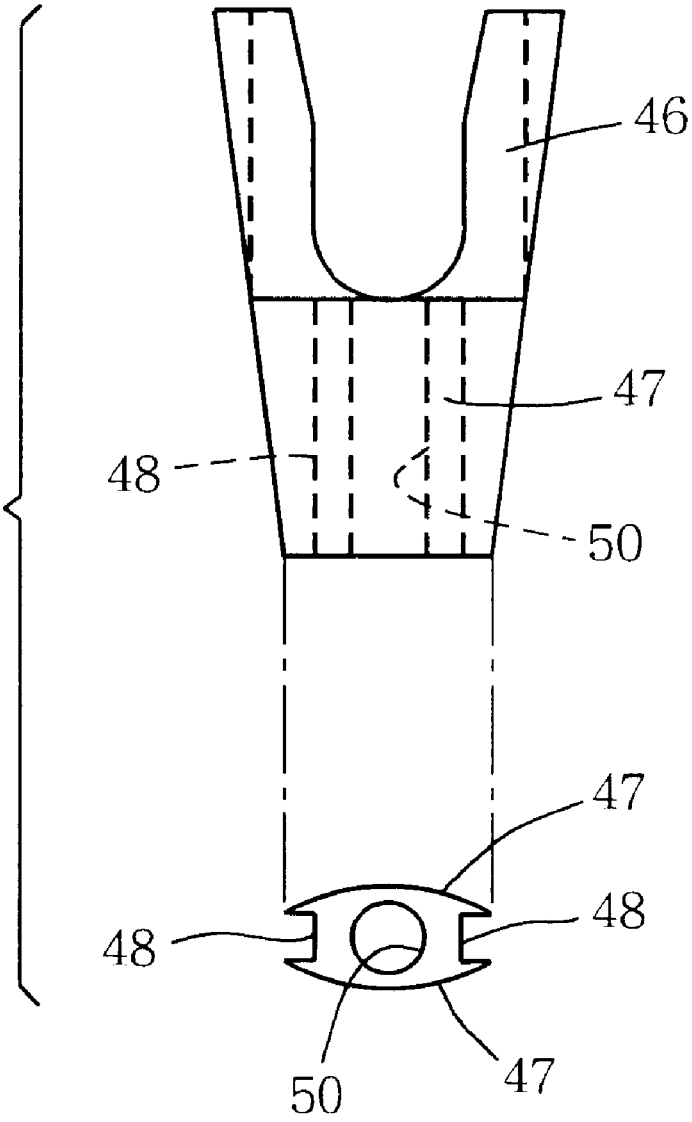
FIG. 6 is a diagram showing a guide provided to the feeder rod guide.

A carrier base 25 of the yarn carrier 12 is provided with a feeder rod 24 that can be moved up and down and a feeder rod guide 26. A yarn feeder 18 for feeding yarn to a needle 6 is mounted at the lower end of the feeder rod 24. The feeder rod guide 26 hangs down from the carrier base 25 and guides the feeder rod 24 in a vertical direction at the lower end of the guide 26. FIG. 4 and FIG. 5 are diagrams showing the feeder rod 24 and the feeder rod guide 25, respectively. FIG. 6 is a front view and a bottom view of a guide 46 that is provided on the feeder rod guide 26.

The feeder rod 24 is provided with a rod 28 that is a long and narrow plate, pipe, etc., a rising guide 38 above the rod 28, a push-down part 40 above the rising guide 38, and a yarn feeder 18 having a yarn feeding eyelet at the bottom end of the rod 28. A spring coil 30 is mounted on the rising guide 38 as a spring for energizing the feeder rod 24 upward. A protruding piece 34 is provided on a feeder box 32 to support the lower end of the spring coil 30, and a slot 36 is made in the rising guide 38 in the vertical direction. The protruding piece 34 is put into this slot 36. The push-down part 40 contacts the lowering means 22 that will be described later. The rising guide is made thicker than the rod 28. In the present embodiment, a pipe-shaped yarn feeder 18 is fitted at the bottom end of the rod 28. A slot 42 is formed in the upper end of the rod 28, and the rising guide 38 and the rod 28 are joined together with a screw 44; their overall height can be adjusted.

The feeder rod guide 26 is made of a thin plate having appropriate elasticity and hardness. The guide 26 is wider than the feeder rod 24. There is a broad part 27 in the lower part of the feeder rod guide 26. To guide the feeder rod 24 in the vertical direction, a guide 46 is fitted at the bottom end of the guide 26. The guide 46 is provided with grooves 48 for vertically guiding the lower parts of the guide 26 and a through hole 50 for vertically guiding the yarn feeder 18. Thick and smooth buffer surfaces 47 are formed on both the front and the back of the guide 46. These buffer surfaces moderate impacts when the yarn carrier 12 come to cross and contact with another yarn carrier 12; the yarn carriers 12 will push each other to separate from each other. As described above, when the feeder rod 24 is guided at the lower end of the feeder rod guide 26 in the vertical direction, yarn will be fed to a needle 6 reliably.

Both the left and right side edges of the broad part 27 in the lower portion of the feeder rod guide 26 are tapered downward to form flanks 52*a*, 52*b* of the yarn carrier 12. They are designed to moderate shocks of contacts the yarn carrier 12 may have with another yarn carrier 12 when the yarn carrier 12 is moved by the catching member 14 that will be described later. The flanks of the yarn carrier 12 are divided into two parts: the lower carrier flanks 52*a* and the upper carrier flanks 52*b*. When two yarn carriers 12, that are normally adjacent to each other, cross with each other, the lower carrier flanks 52*a* of the respective yarn carriers 12 will contact with each other. Since the lower carrier flanks 52*a* are tapered towards the bottom end, they can moderate shocks of contacts between the yarn carriers 12. At the time of a contact, the feeder rod guides 26 of both yarn carriers 12 will be flexed, and the guides 46 of the two yarn carriers 12, being provided on the feeder rod guides 26, will contact with each other. Since buffer surfaces 47 being thick smooth slopes are formed on the guides 46, the guides 46 will moderate the shocks of contacts between the yarn carriers 12. The buffer surfaces 46 act to push against each other to separate the yarn carriers.

When a yarn carrier 12, that is moving with its feeder rod guide 26 being flexed due to a contact with another yarn carrier 12, cross another (third) yarn carrier 12, their upper carrier flanks 52*b* will contact with each other. Since the upper flanks 52*b* are tapered downward just like the lower flanks 52b, they can moderate the shocks of contacts between yarn carriers 12.

Slopes 53, being tapered downward, are formed on both left and right side edges of the top end of the feeder rod guide 26, that is below the guide 46. These slopes 53 act to avoid interference with yarn extending from another yarn carrier 12 to the needle 6 when the yarn carrier 12 is moved by the catching member 14. The feeder rod guide 26 of the present invention is formed integrally with the carrier base 25 to reduce the number of parts of the yarn carrier 12 and the weight thereof.

An engaging means 54 is formed on the top end of the yarn carrier 12, and the catching member 14, that will be described later, makes a catching pin 20 engage with the engaging means 54 to catch and trail the yarn carrier 12. The engaging means 54 is formed between a pair of left and right swing pieces 56, 56 that are supported by axes in the upper portion of the yarn carrier 12 so that they can swing in vertical directions. One end, on the center side of the yarn carrier 12, of the swing piece 56 is energized upward by a spring coil 59 in a groove 58 of the feeder box 32 to assume a position higher than the fulcrum of the swing piece 56.

The catching member 14 comprises a solenoid 62 and a transmission lever 64. The solenoid 62 receives signals from a controller not illustrated to make an output plunger 60 protrude or retract. The transmission lever 64 transmits the movement of the output plunger 60 of the solenoid 62 to the catching pin 20. The catching pin 20 is energized downward by a spring coil 66, and the catching member 14 makes the catching pin 20 engage with the engaging means 54 formed between a pair of left and right swing pieces 56, 56 on the top of each yarn carrier to catch and trail the yarn carrier 12.

With the feeder rod 24 being energized upward by the spring coil 30, the rising guide 38 of the feeder rod 24 is supported in a groove 68 made in the feeder box 32 so that the feeder rod 24 can be moved upward and downward. The lowering means 22 is provided with a cam plate 70 for pressing down the feeder rod 24, and the cam plate 70 is linked with the catching pin 20 of the catching member 14, via a linking arm 72. Being interlocked with the vertical movements of the catching pin 20, the cam plate 70 will swing to and fro with a pin 74 of the swing axis as the center. On the lower end of the cam plate 70 is formed a push-down cam 78 for pushing down the top end 76 of the push-down part 40 of the feeder rod 24. When the cam plate 70 of the lowering means 22 pushes down the feeder rod 24, the yarn feeder 18 being provided at the lower end of the feeder rod 24 will protrude from the bottom end of the feeder rod guide 26.

Next, the action of the yarn feeding system at the time of knitting will be described.

When the carriage 8 is driven by a belt driving means, according to output signals of a controller not illustrated, to travel over the needle bed 2, needles 6 arranged on the needle bed 2 are moved forward or backward by knitting cams 9. When the carriage 8 is travelling, for a portion for which knitting is not made, the solenoid 62 will be actuated by an output signal for pattern knitting to make the output plunger 60 protrude downward. The catching pin 20 of the catching member 14 will be raised by the output plunger 60, via the transmission lever 64, against the tensile force of the spring coil 66. With the rising of this catching pin 20, the cam plate 70 of the lowering means 22 will be swung up with the swing axis pin 74 as the center.

For a portion for which knitting is made, at a point this side of a position at which the carriage 8 faces a specified yarn carrier for feeding yarn to a needle 6, the solenoid 62 will be actuated by an output signal of the controller not illustrated, and the output plunger 60 will be retracted upward. The catching pin 20, that has been raised, will be pushed down by the tensile force of the spring coil 66. Being interlocked with the pushing down of the catching pin 20, the cam plate 70 of the lowering means 22 will be swung, via the linking arm 72, towards the yarn carrier 12 with the swing axis pin 74 as the center.

Figure 7:
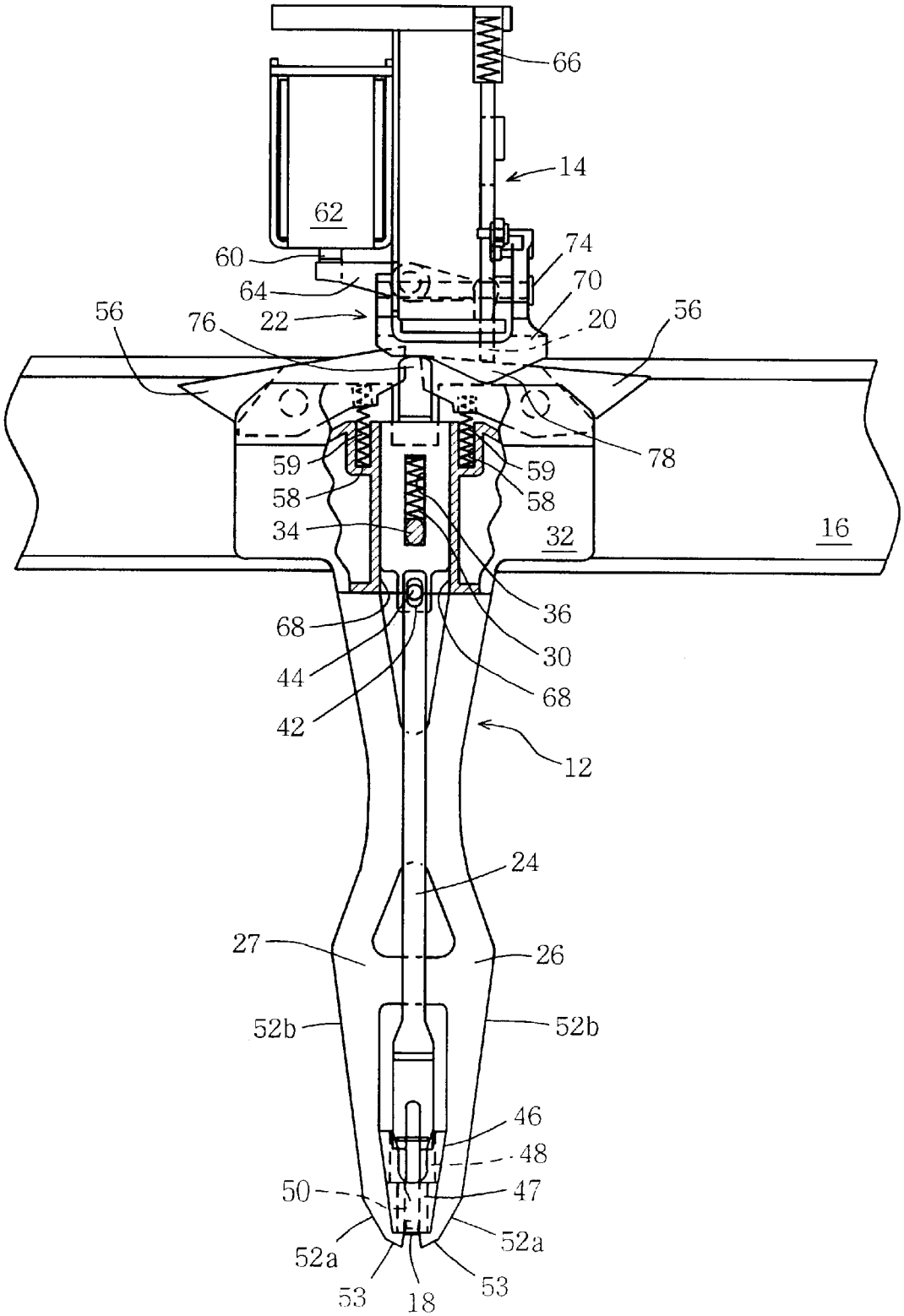
FIG. 7 is a diagram showing that the lower end of a catching pin of a catching member is in contact with the top of a swing member.

The carriage 8 travels, and the lower end of the protruding catching pin 20 will come to contact with the top of a swing piece 56, on the upstream side of the travel direction of the carriage 8, of the pair of left and right swing members 56 in the upper part of the yarn carrier 12. As a result, one end, on the center side of the yarn carrier 12, of the swing member 56 will be swung downward against the upward energization by the spring coil 59 (FIG. 7). When the carriage 8 travels further, the push-down cam 78, that is formed on the lower end of the cam plate 70, will come to contact the top end 76 of the push-down part of the feeder rod 24 to push the feeder rod 24 downward. As a result, the yarn feeder 18 at the bottom end of the feeder rod 28 will protrude from the bottom end of the feeder rod guide 26 so that it can feed yarn to a needle 6.

Figure 8:
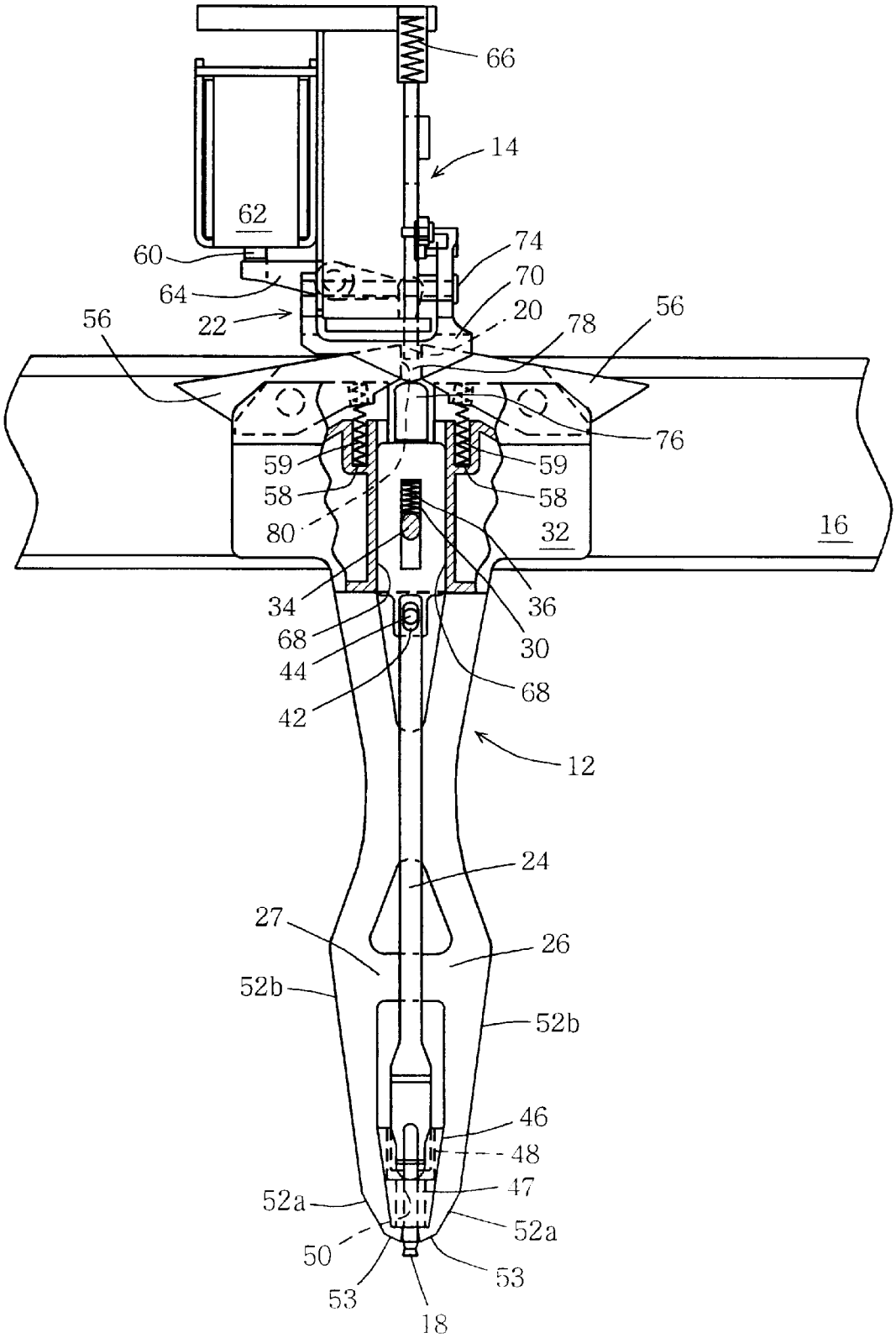
FIG. 8 is a diagram showing that the yarn carrier is being caught and trailed by the catching member.

When the catching pin 20 enters into the engaging means 54 between swing pieces 56, 56, the swing piece 56, that has been swung downward by the catching pin 20, will be swung back to the original position by the upward energization of the spring coil 59. As a result, the catching pin 20 will be held between the sides 80 of the pair of swing pieces 56, 56, and the yarn carrier 12 will be trailed by the carriage 8. At this time, yarn will be fed from the yarn feeder 18 of the yarn carrier 12 to a needle 6 (FIG. 8). With this arrangement, even if knitting of a fabric is made at a high speed, the catching member 14 can reliably engage the catching pin 20 with the engaging means 54 to catch and trail a yarn carrier 12.

In the present embodiment, between a pair of left and right swing pieces 56, 56 that are provided on the yarn carrier at the top end and near the center thereof, is provided a space sufficient for engagement of the catching pin 20 of the catching member 14. However, it is not always necessary to provide a space between the pair of left and right swing pieces 56, 56.

When the carriage 8 comes to a specified position for releasing the yarn carrier 12 or actuating another yarn carrier 12, the solenoid 62 will be actuated by an output signal from the controller not illustrated, and the output plunger 60 will be made to protrude downward. As a result, the catching pin 20, that has been lowered, will be pushed up against the tensile force of the spring coil 66. With the rise of this catching pin 20, the cam plate 70 of the lowering means 22 will be swung up with the swing axis pin 74 as the center.

When the catching pin 20 is raised and, in turn, the engagement between the catching pin 20 and the side 80, on the center side of the yarn carrier, of the swing piece 56 on the downstream side of the travel direction of the carriage 8 is undone, the yam carrier 12 will be released, and due to swinging up of the cam plate 70, the feeder rod 24, that has been pressed down, will be pushed up by the spring coil 30 to a position at which the yarn feeder 18 at the bottom end thereof will not interfere with the yarn feeder 18 of another yarn carrier 12, a needle 6, a sinker, etc.

When the carriage 8 comes to a position for actuating another yarn carrier 12, the solenoid 62 will be actuated by an output signal of the controller, and the output plunger 60 will be retracted upward. The catching pin 20, that has been raised, will be pushed down by the tensile force of the spring coil 66, and the cam plate 70 of the lowering means 22 will be swung towards the yarn carrier 12 with the swing axis pin 74 as the center. The catching pin 20 will be lowered to enter into the engaging means 54 of the yarn carrier 12. Under this condition, when the carriage 8 travels further, the push-down cam 78, that is formed on the lower edge of the cam plate 70, will push down the feeder rod 24, and the yarn feeder 18, that is provided at the bottom end of the feeder rod, will protrude to the yarn feeding position in which the yarn feeder 18 is close to the top end of the needle 6. After that, the fabric is knitted with yarns fed by yarn feeders of yarn carriers 12 selected in a procedure similar to that described above.

Figure 9:
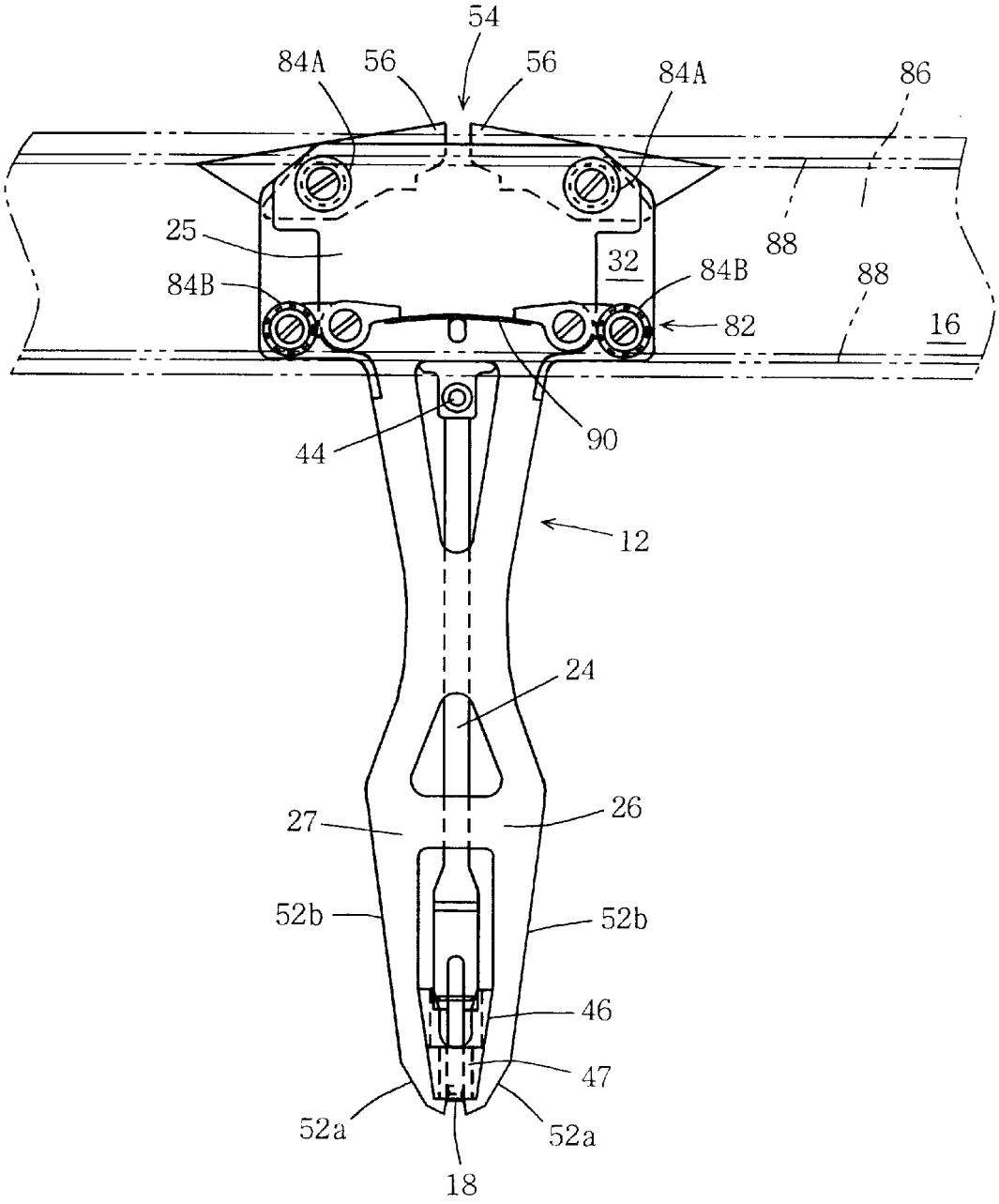
FIG. 9 is a diagram showing a support means seen from the back of the yarn carrier.

FIG. 9 is a diagram showing a supporting means 82 for supporting a yarn carrier 12 on a carrier rail 16, that is seen from the rear of the yarn carrier 12. A pair of left and right rollers 84A, 84A and a pair of left and right rollers 84B, 84B are mounted in the upper part and the lower part of the carrier base 25 of the yarn carrier 12, respectively. Grooves 86 are made on both the front and the back of the carrier rail 16 in the longitudinal direction thereof. Protruding slopes 88 conical in section are provided in the upper part and the lower part of each groove 86. The yarn carrier 12 is supported by fitting the upper and lower pairs of left and right rollers 84A, 84B on the protruding slopes 88 conical in section, that are formed on the carrier rail 16. The lower pair of left and right rollers 84B, that are mounted on the yarn carrier 12, are energized downward by a leaf spring 90 that is provided between the rollers. With this, the yarn carrier 12 is supported on the carrier rail 16 more reliably. When the yarn carrier 12 is supported on the carrier rail 16 as described above, the yarn carrier 12 can be effectively prevented from coming off the carrier rail 16 and the carrier 12 can be moved with lower friction.

The carrier rail 16 is provided with plates made of a magnetic material, that are not illustrated, over the entire length thereof. These plates are attracted by a magnet, not illustrated, that is mounted on the yarn carrier being held on the carrier rail 16, on a surface opposing the above plates. Because of this arrangement, when the yarn carrier 12 is released from the catching pin 20, the yarn carrier 12 will quickly come to a halt due to the attractive force of the magnet.

Supporting means 82 are not limited to rollers. Any means of low frictional resistance such as ball bushings may be used. The carrier rail 16 can be reduced in weight by making the carrier rail 16 from aluminium or the like, and making the slopes 88 conical in section that directly support the rollers 84 of the yarn carrier 12 from steel.

With regard to the lowering means 22, being linked with catching of the yarn carrier 12 by the catching member 14, the cam plate 70 makes the feeder rod 24 move downward. In this way, the downward movement of the feeder rod 24 is made greater than the amount of protrusion of the catching pin 20. However, the feeder rod 24 may be moved downward directly by the catching pin 20, etc.

In the above embodiment, flanks 52 are formed on both the left and right side edges in the lower portion of the feeder rod guide 26. These flanks are intended to moderate impacts of a contact that will occur when the yarn carrier 12 is moved by the catching member 14 to cross another yarn carrier 12. However, if the feeder rod guides 26 of yarn carriers 12 do not contact with each other, for example, when the amount of vertical movement that the feeder rod 24 can make is increased and the push-down amount of the feeder rod 24 by the cam plate 70 of the lowering means 22 is increased, there is no need of forming flanks 52 on the feeder rod guides 26.

Figure 10:
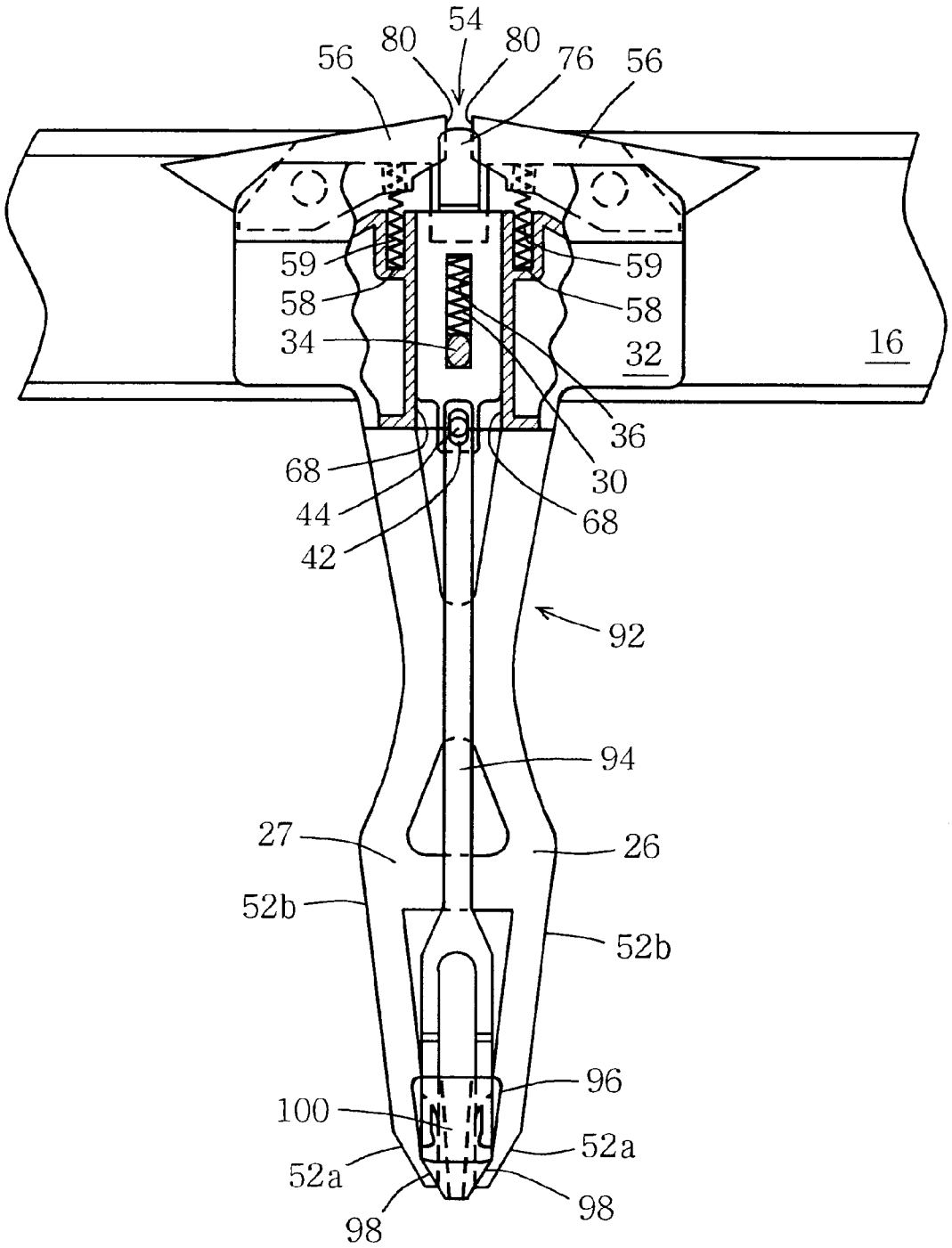
FIG. 10 is a partially cutaway front view of a yarn carrier of a modification.

Next, a modification of the present invention will be described with reference to drawings. FIG. 10 is a partially cutaway front view of a yarn carrier 92. In this modification, flanks 98 for yarn are formed on both sides of a yarn feeder 96 having a yarn feeding eyelet, that is provided at the lower end of the feeder rod 94, by tapering towards the lower end of the yarn feeder 96. The lowering means 22 makes the feeder rod 94 move downward. The feeder rod 94, in turn, makes the yarn feeder 96 having flanks for yarn on both sides thereof protrude from the top end of the feeder rod guide 26. With this arrangement, when the yarn carrier 92 is moved by the catching member 14, the yarn feeder 96 at the bottom end of the feeder rod 94 will not interfere with any yarn extending from the yarn feeder 92 of another yarn carrier 92 to a needle 6; thus more stable supply of yarn can be achieved. The yarn feeder 96 having flanks 98 for yarn is provided with thick and smooth slopes 100 formed on the front and the back of the yarn carrier. These slopes 100 act in such a way that the yarn carrier 92 pushes away another yarn carrier 92.

Figure 11:
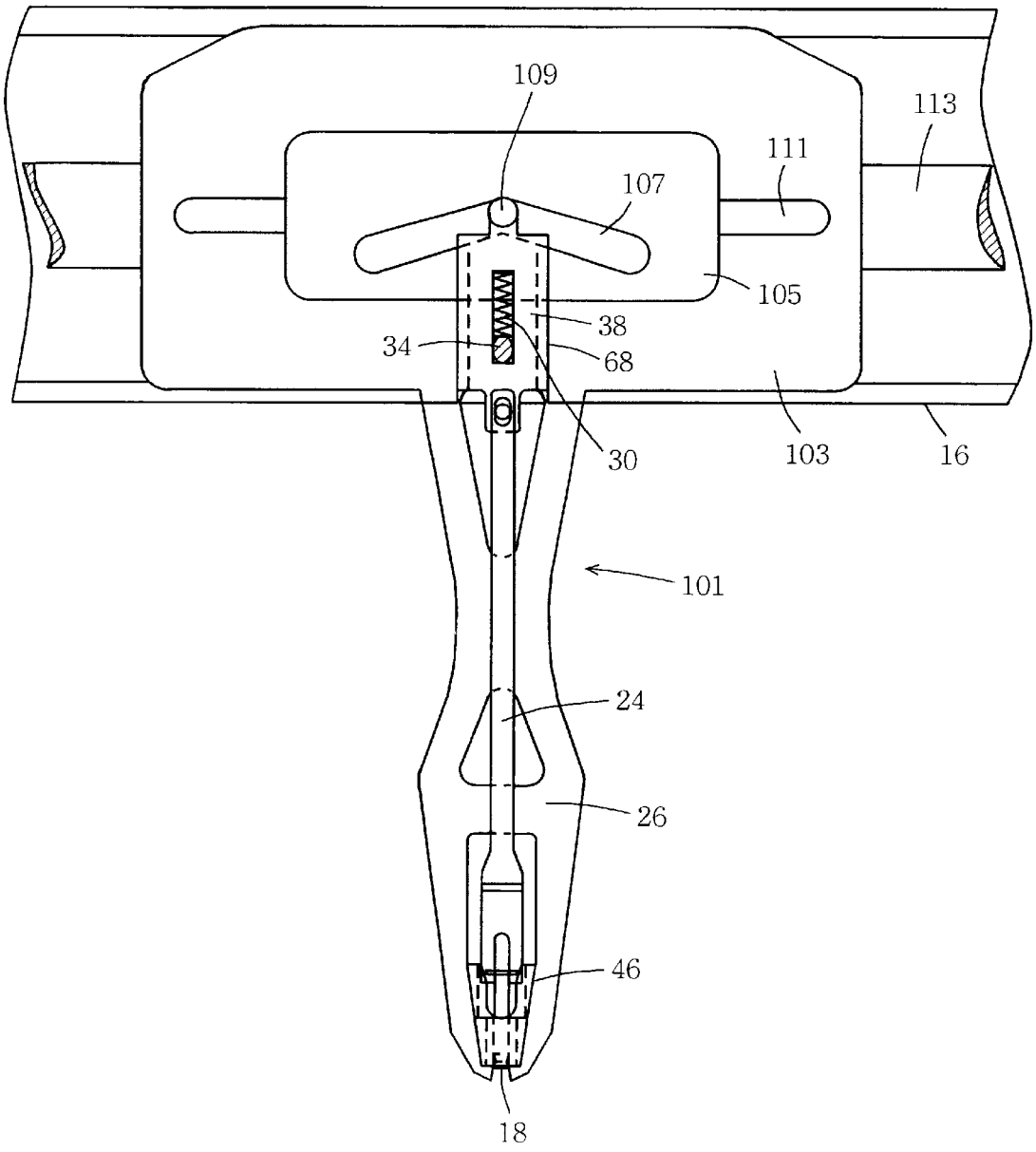
FIG. 11 is a front view of a yarn carrier of another modification.
Figure 12:
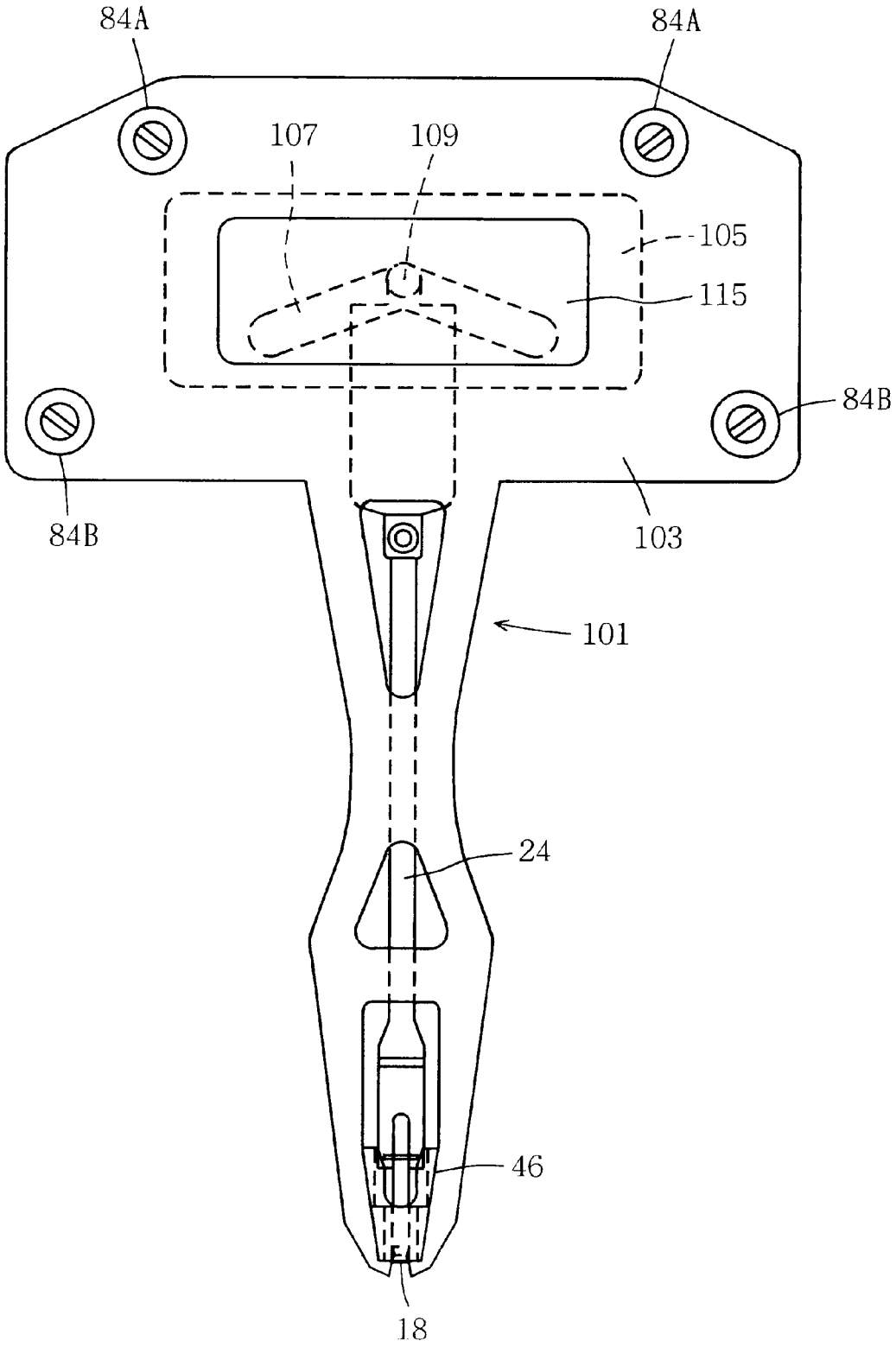
FIG. 12 is a rear view of the yarn carrier of above modification.

With reference to FIG. 11 and FIG. 12, another modification will be described. Except some points that will be described below, this modification is similar to other embodiments. A new yarn carrier 101, that is similar to the yarn carrier 12 of FIG. 1 through FIG. 9, is used. In FIG. 11, 103 denotes a carrier base. A cam plate 105 is provided so that the cam plate 105 can slide sidewise relative to the base 103. A cam groove 107 and a pin 109 that is provided at the top of a member 38 are arranged so that the pin 109 can slide in the cam groove 107. 111 denotes a slide groove that allows the cam plate 105 to slide relative to the base 103. 113 is a driving belt that makes the yarn carrier 101 run along the rail 16.

The rear of the yarn carrier 101 is shown in FIG. 12. 115 denotes a magnet that is mounted on the back of the cam plate 105. The magnet 115 attracts, for example, the rail 16 made of steel, and generates a frictional force on the cam plate 105 so that the cam plate 105 lags behind the base 103 in movement. As a result, when the yarn carrier 101 is made to run by the belt 113, a kind of force of inertia due to the magnet 115 will work on the cam plate 105, and the cam plate 115 will slide backward relative to the moving direction in the slide groove 111. The pin 109 will be pushed down, and the feeder rod 24 will move downward and the yarn feeder 18 will come close to a needle. When the belt 113 is stopped and the yarn carrier 101 is stopped, under the influence of the spring coil 30, the pin 109 will move towards the center of the slide groove 107. With this force, the cam 105 will move in the slide groove 111, and the pin 109 will be restored to the top of the groove 107.

In FIG. 11 and FIG. 12, the yarn carrier 101 is driven by the belt 113. However, it may be driven by the catching member 14. In that case, the cam plate 70, etc. will not be required. With regard to processing after stoppage of the yarn carrier 101, for example, the belt 113 may be moved in the reverse direction just a little to use the force to restore the cam plate 105. Or the restoring force of the pin 109 to the top of the cam groove 107 may be increased by attaching one end of a spring coil to the left and one end of another spring coil to the right of the spring coil and attaching the other ends of the spring coils to the cam plate 105.

In the above embodiments, a flat knitting machine in which plural carrier rails 16 are arranged radially was described. The present invention, however, can be applied to a flat knitting machine in which plural carrier rails 16 are arranged horizontally. In this case, to bring the lower ends of the yarn carriers 12, 92 close to a needle 6, the feeder rod guides 26 are bent in the middle, and the rods of the feeder rods 24, 94 are mode of a flexible material such as a leaf spring.

I claim:

1. A flat knitting machine having at least a pair of needle beds with a large number of needles, one in a front and one in a back, top ends of said needle beds being opposed to each other so as to form a trick gap in between, said flat knitting machine having a yarn feeding system comprising at least a carrier rail arranged above the needle beds and a yarn carrier movable along the carrier rail and for feeding yarn to the needles, said flat knitting machine characterized in that said yarn carrier comprises:

a base movable along the carrier rail;

a planar plate guide disposed substantially parallel with said carrier rail and having one end fixed to said base, said plate guide extending downwards from said base near the trick gap; and a feeder rod extending from the base towards the trick gap, movable vertically, having a yarn feeding eyelet at a bottom end towards the trick gap, and being supported by said plate guide proximate said yarn feeding eyelet, and that said flat knitting machine further comprises:

raising means for keeping said feeder rod in a raised position while the yarn feeder is in a stand-by position; and lowering means for lowering said feeder rod while yarn is to be fed from said yarn feeding eyelet to a needle.

2. A flat knitting machine having a yarn feeding system of claim 1 characterized by a plurality of said carrier rails and a plurality of said yarn carriers being provided;

said plate guide and said base being an integral member;

the plate guides of the plural yarn carriers being arranged in radial directions having a center at the trick gap; and the feeder rods being movable up and down in the radial directions.

3. A flat knitting machine having a yarn feeding system of claim 1 characterized by said plate guide being broader than said feeder rod and having two side edges along the carrier rail being tapered towards the bottom end thereof.

4. A flat knitting machine having a yarn feeding system of claim 1, wherein said plate guide is broader than said feeder rod, has two side edges along the carrier rail being tapered towards the bottom end thereof, and has a member being located near the bottom end of said feeder rod and above the yarn feeding eyelet, surrounding the feeder rod, being thicker in an upper part thereof than in a lower end thereof, being tapered towards the yarn feeding eyelet, and having an elliptic horizontal section having a major axis being parallel with the carrier rail and a minor axis being perpendicular to the carrier rail.

5. A flat knitting machine having a yarn feeding system of claim 1 characterized by a yarn feeding member mounted on a lower end of said feeder rod, tapered towards the trick gap, and having a bottom end forming said yarn feeding eyelet.

6. A flat knitting machine having a yarn feeding system of claim 1 characterized in that said plurality of carrier rails are arranged along an arc facing said trick gap.

7. A flat knitting machine having a yarn feeding system including at least a pair of needle beds with a large number of needles, one in a front and one in a back, top ends of said needle beds being opposed to each other so as to form a trick gap in between, said flat knitting machine having a yarn feeding system comprising at least a carrier rail arranged above the needle beds and a yarn carrier movable along the carrier rail and for feeding yarn to the needles, said flat knitting machine characterized in that said yarn carrier comprises:

a base movable along the carrier rail;

a plate guide having one end fixed to said base and extending from said base towards the trick gap; and a feeder rod supported by said plate guide, extending from the base towards the trick gap, movable vertically, and having a yarn feeding eyelet at a bottom end towards the trick gap side, and that said flat knitting machine further comprises:

raising means for keeping said feeder rod in a raised position while the yarn feeder is in a stand-by position, said raising means comprises a spring having two ends, one end mounted on said base and another end mounted on the feeder rod, and pushing up the feeder rod;

lowering means for lowering said feeder rod while yarn is to be fed from said yarn feeding eyelet to a needle; and a second guide is mounted on said base and guides the feeder rod vertically.

8. A flat knitting machine having a yarn feeding system of claim 7 further comprising:

a catching member for catching and trailing the yarn carrier and comprising a main part, a pin driven by a solenoid so as to descend from the main part, swing members swingably mounted on the main part, and a rotational arm having two ends and rotatably mounted at said two ends, one at said swing member and one at said pin; and an engaging member formed on an upper end of the base of said yarn carrier and engageable with the pin of said catching member, wherein said feeder rod has a top engageable with and pushed down by said swing member while the swing member is swung towards the top.

9. A flat knitting machine having a yarn feeding system of claim 8 characterized by a pair of swing pieces provided on the upper end of said base, being able to swing in a vertical plane, and having a gap in between and respective ends at said gap pushed up, and by said engaging member comprising said gap.

* * * * *